United States Patent [19]

Singer

[11] Patent Number: 5,058,948

[45] Date of Patent: Oct. 22, 1991

[54] FOLDABLE CHAIR

[76] Inventor: Mark A. Singer, 1150 Oroile Rd., Santa Barbara, Calif. 93108

[21] Appl. No.: 459,514

[22] Filed: Jan. 2, 1990

[51] Int. Cl.[5] ..... A47C 4/44

[52] U.S. Cl. ..... 297/18; 297/25; 297/56

[58] Field of Search ..... 297/16, 18, 25, 56, 297/258

[56] References Cited

U.S. PATENT DOCUMENTS

| | | | |
|---|---|---|---|
| 3,154,344 | 10/1964 | Stableford | 297/18 |
| 3,338,625 | 8/1967 | Jung-Shien | 297/18 |
| 3,822,913 | 7/1974 | Raver | 297/18 |
| 4,251,106 | 2/1981 | Gilbert | 297/18 |
| 4,597,604 | 7/1986 | Singer | 297/18 |
| 4,699,422 | 10/1987 | Yamasaki | 297/25 X |

FOREIGN PATENT DOCUMENTS

| | | | |
|---|---|---|---|
| 529792 | 6/1955 | Italy | 297/18 |

*Primary Examiner*—Peter A. Aschenbrenner
*Attorney, Agent, or Firm*—Spensley Horn Jubas & Lubitz

[57] ABSTRACT

A chair comprises an inclined front support member and an oppositely inclined rear support member intersecting the front support member. A seat is fixed to the rear support member and extends in a generally horizontal direction. An upper tension member near the seat and a lower tension member near the base connect the front support member to the rear support member in such a manner that controlled motion is achieved, without the need for additional tension members.

21 Claims, 2 Drawing Sheets

FOLDABLE CHAIR

BACKGROUND OF THE INVENTION

1. Field of the Invention

This invention relates to chairs, and more particularly to chairs which are foldable.

2. Description of Related Art

Efforts to produce chairs which are both comfortable and functional have resulted in a wide variety of chair designs and styles. For example, conventional chairs consisting of a seat directly supported by four legs are well known It is also well known that the rear legs can be extended above the seat to form a backrest, or that a pair of curved rockers can be attached to the lower ends of the legs to make a rocking chair. However, chairs having this type of rigid structure are bulky and are not easily portable.

As a result, foldable chairs have flourished. One type of foldable chair utilizes oppositely inclined front and rear support members, both of which directly support the seat. The support members intersect such that when viewed from the side an "X" shape is formed. The support members are pivotally joined at the point of intersection to allow the chair to fold. Chairs of this type require complex structural arrangements to allow the seat to fold when the support members are collapsed.

Alternatively, the oppositely inclined support members are not joined, but are allowed to move relative to one another and pivot with respect to the ground to create a rocking motion. To maintain this type of support structure in an upright position, several additional members are necessary. Otherwise, the ends of the support members will move apart causing the chair to collapse. Additionally, because both support members are attached to the seat, the seat must be flexible enough to allow the support members to pivot. Traditionally, this is accomplished by providing a tension or support member which joins the frame members together in a specific configuration. Then, a flexible hammock-like sheet is draped from the front support member to the rear support member to support a person seated in the chair. The sheet helps serve the functions of connecting the support members and supporting the weight of the person sitting in the chair. As a result of the single sheet draped loosely between the front and rear support members, chairs of this type are often uncomfortable and may be difficult to get into and out of. Further, such chairs often have a complex structure which may not limit forward or rearward motion.

Examples of patents directed to chairs somewhat similar in design to the chair of the present invention are U.S. Pat. Nos. 4,470,630; 4,118,064; 3,154,344; and 3,338,625.

SUMMARY OF THE INVENTION

One object of the present invention is to provide an improved chair which is durable, comfortable and functional.

A further object of the present invention is to provide an improved chair which may be easily folded and readily portable, and which easily adjusts to a wide variety of body configurations.

A further object of the present invention is to provide an improved chair with relatively few members, that is, simple in structure and easy to manufacture.

In accordance with these and other objects, a preferred embodiment of the chair of the present invention comprises a front support member which is inclined from the horizontal and defines a planar surface, an oppositely inclined rear support member intersecting the planar surface and first and second tension members. The first tension member connects the front support member to the rear support member adjacent the ground, and prevents the bottom ends of the support members from sliding apart. The second tension member connects the front and rear support members to maintain the support structure in an upright position by preventing the top ends of the support members from separating. This second tension member also limits forward rocking motion and can define a seating surface for the user.

Because of the unique configuration of the chair of the present invention, a stable rocking chair is achieved which can be folded by collapsing the first tension member and placing the front support member adjacent the rear support member.

These and other objects and aspects of the invention will become apparent to those skilled in the art from the following detailed description of the invention which is provided by way of example and not as limitation.

BRIEF DESCRIPTION THE DRAWINGS

DETAILED DESCRIPTION OF THE DRAWINGS

Figure 1:
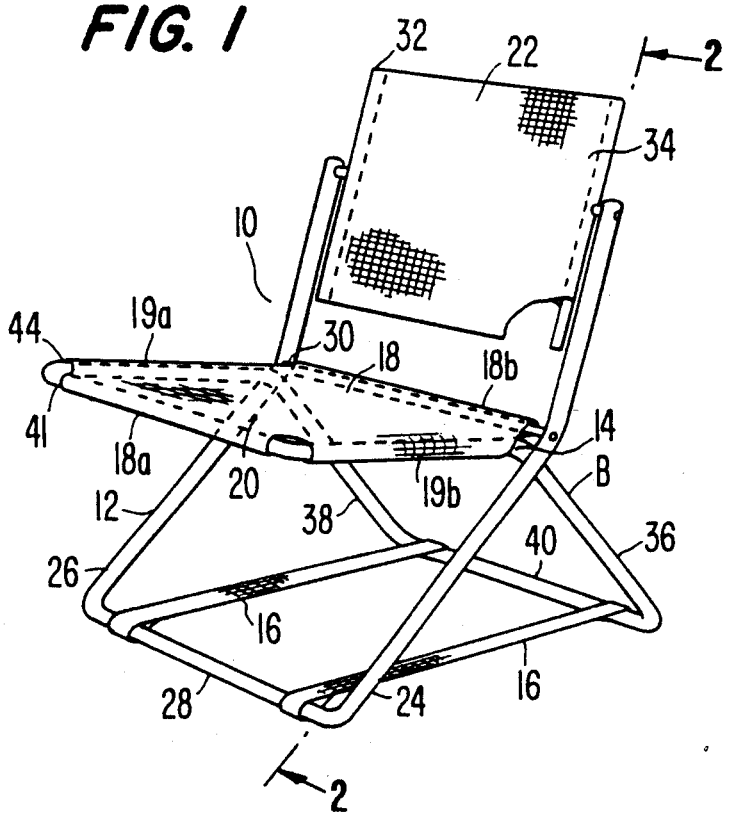
FIG. 1 is an elevated perspective view of a chair in accordance with a preferred embodiment of the present invention.
Figure 2:
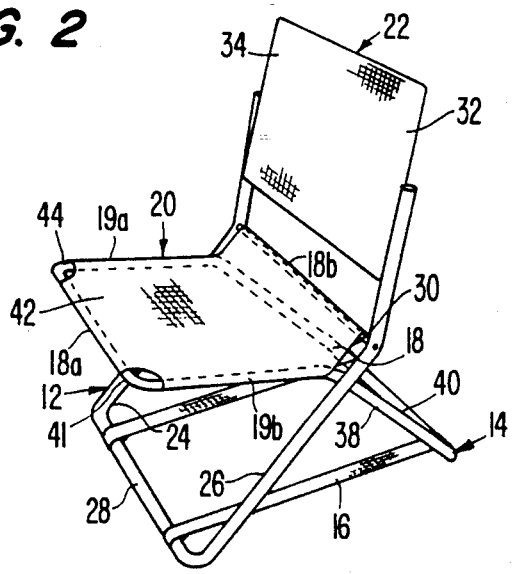
FIG. 2 is an elevated perspective view of the chair shown in FIG. 1 in a different position.

A chair 10 in accordance with a preferred embodiment of the invention is shown in FIGS. 1 and 2. The chair 10 comprises a front support member 12 inclined from the horizontal, and an oppositely inclined rear support member 14 intersecting a plane defined by the front support member 12, but preferably not touching the front support member 12. The front support member 12 and the rear support member 14 are connected near the base of the chair adjacent the ground with a first tension member 16. A second tension member 18 joins members 12 and 14 together and helps define a seating surface 20. Preferably, a backrest 22 is attached to the front support member 12.

In the embodiment shown in FIG. 1, the front support member 12 is made of two transversely spaced tubular struts 24 and 26 which are maintained in fixed positions relative to each other by crossbars 28 and 30. In the particular embodiment shown, one crossbar 28 connects the struts 24 and 26 at their extreme lower ends and is integrally formed with the tubular struts. This configuration allows the struts and crossbar to be easily manufactured from a single piece of appropriately bent tubular material. Second crossbar 30 is inserted near the mid-point of the struts 24 and 26 adjacent bend A by methods well known in the art.

Although the illustrated embodiment shows one integrally formed lower crossbar 28 and one separately formed upper crossbar 30, in other embodiments it is possible that both crossbars can be integrally formed or that both crossbars could be separately formed and then attached to the struts. Likewise, the crossbars 28 and 30 can be attached to the struts 24 and 26 at some other locations and in some other configurations as long as they maintain the struts relatively fixed in relation to each other while the chair is in use, permit rocking action and also limit forward and rearward movement.

The struts 24 and 26 of the front support member 12 are preferably bent at the same angle so that nesting of the chair can be achieved. Bend angles of from about 120° to about 160° are within the scope of the invention. Preferably, struts 24 and 26 are bent at an angle such that the upper portion of support member 12 extends upward in a generally vertical direction in order to support backrest 22. The backrest 22 is made of a flexible material 34 suspended between two support members 32 pivotally connected to the upper portions of the struts 24 and 26 and received in tunnels formed in material 34. This structure allows the backrest 22 to pivot with respect to the front support member 12 to comfortably conform to the position of a person seated in the chair 10.

In the illustrated embodiment, the rear support member 14 is made of two transversely spaced struts 36 and 38 separated by integrally formed lower crossbar 40 and upper crossbar 41, which maintain the struts in a separated position. Struts 36 and 38 are preferably bent at the same angle also to encourage nesting of the chair. Bend A' in struts 36 and 38 can be from about 120° to about 160°. Preferably, struts 36 and 38 are bent at an angle such that a generally horizontal seating platform is achieved. As discussed above, various strut and crossbar configurations can be used in other embodiments.

Figure 3:
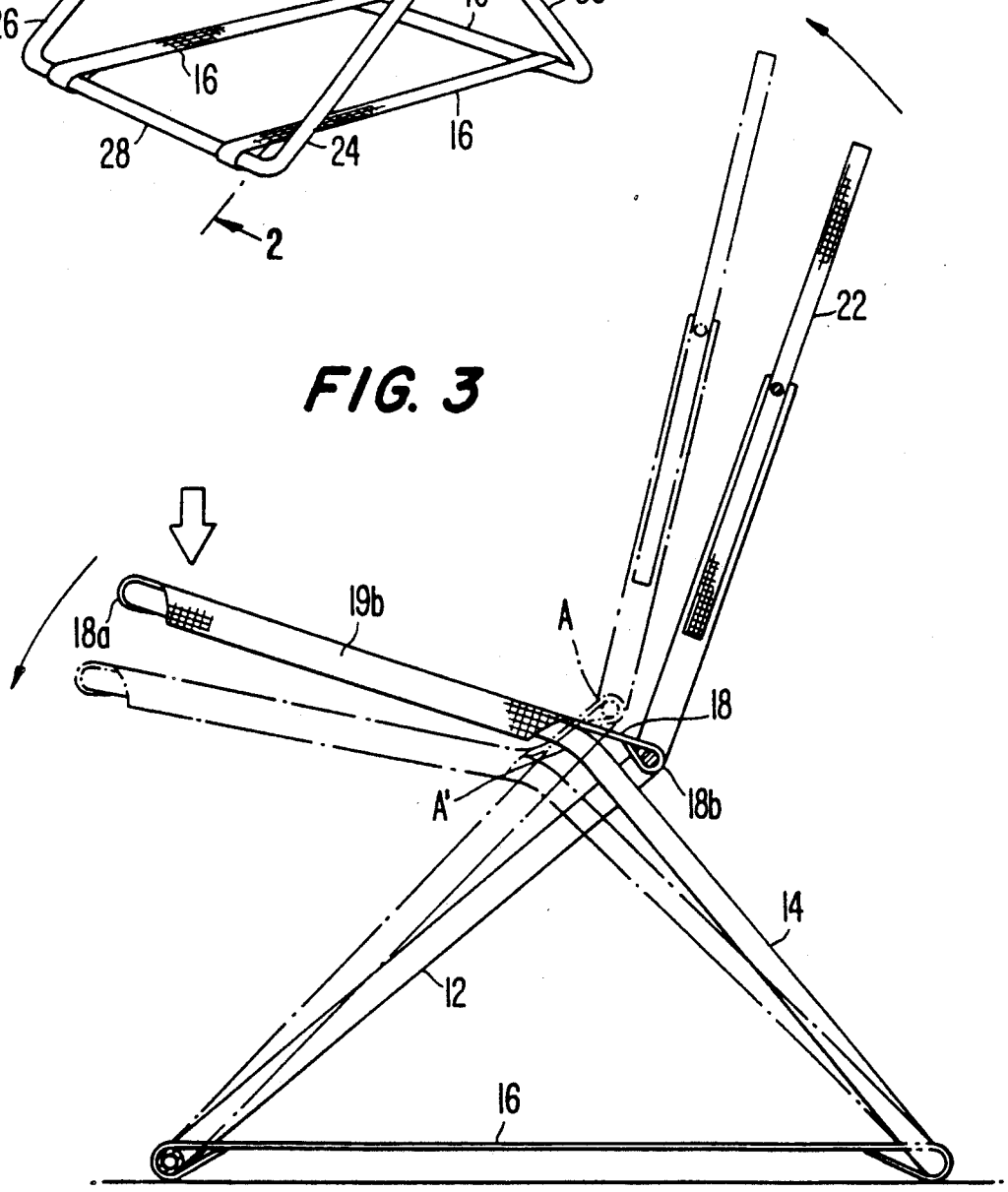
FIG. 3 is a side view of the chair shown in FIG. 1.

The front support member 12 and the rear support member 14 are oppositely inclined from the horizontal and the rear support member 14 intersects a plane defined by front support member 12 such that when viewed from the side, a general "X" shape is formed. However, the front support member 12 and the rear support member 14 do not usually touch. The struts 36 and 38 of the rear support member 14 are spaced closer together than the struts 24 and 26 of the front support member 12. Thus, the rear support member 14 fits within the struts 24 and 26 of the front support member 12 at the point of intersection. As seen in FIGS. 1, 2 and 3, the two support members 12 and 14 are not connected at the point of intersection, rather, they are left free to move relative to one another.

Two strips of flexible material act as first tension member 16 connecting the front support member 12 to the rear support member 14 near the base of the chair 10 and adjacent the ground. This prevents the bottom ends of the support members 12 and 14 from sliding apart. The strips extend from the lower crossbar 28 of the front support member 12 to the lower crossbar 40 of the rear support member 14 and are attached to the crossbars by loops formed in the ends of the strips. The length of the strips can be adjusted to produce the desired height and angle of the seat. Other means for joining the support member together so as to define a stable base, e.g., rods or the like, are also within the scope of this invention Second tension member 18 connects the front and rear support members 12 and 14 adjacent the point of intersection. This prevents the support members from falling due to gravity and maintains the support structure in an upright position. Second tension member 18 can also define a flexible seat 20. In the preferred embodiment, second tension member 18 has a generally rectangular configuration with first and second ends **18*a* and 18*b*, first and second sides 19*a* and 19*b* and a central seat 20. Tension member 18, and specifically ends 18*a*, 18*b*, are attached to crossbar 30 of the front support member 12, and to crossbar 41 of rear support member 14**.

In the illustrated embodiment, the seat portion 20 of tension member 18 is formed of a flexible material, attached to support frame 44. Frame 44 is formed of the upper portion of struts 36 and 38 and crossbar 41. The sides **19*a* and 19*b* of tension member 18 are attached to struts 36 and 38 of the rear support member. In alternative embodiments, the seat may be of rigid material with the upper tension member 18** attached to the front support member and the seat in any conventional manner known to those skilled in the art or the upper tension member could extend directly from the front support member to the rear support member at a point behind a separately formed seat.

The use of tension members 16 and 18 to connect the support members together allows the front support member 12 and the rear support member 14 to pivot and move relative to one another. Thus, when weight is placed on the seat portion of tension member 18, the rear support member 14 pivots forward and down as shown in FIG. 2. At the same time, the front support member 12 pivots forward and up. Similarly, if pressure is exerted against the backrest 22, the front support member 12 pivots back and down causing the rear support member 14 to pivot backward and the seat portion of tension member 18 to move up as illustrated in FIG. 3. As a result, a person sitting in a chair 10 in accordance with the present invention can produce a "rocking" motion merely by shifting his/her bodyweight from the seat support portion of tension member 18 to the backrest 22.

Another important aspect of the invention is the location at which tension member 18 is joined to struts 36 and 38. Specifically, tension member 18 has opposite side portions **19*a*, and 19*b* which wrap around struts 36 and 38 and helps secure the seat portion 20 of tension member 18 to the rear support member 14. Side portions 19*a* and 19*b* are joined to struts 36 and 38 at location B such that when the chair 10 is unfolded, it can only be moved or rocked forward to a position where the seat 20 is generally horizontal. As can be seen in FIGS. 1 and 2, this is achieved by attaching side portions 19*a* and 19*b* to the struts 36 and 38 adjacent bend A'. Further, because tension member 18 joins rear support member 14 to front support member 12 (via crossbar 30), and also controls the relative movement between members 12 and 14 (via attachment of 18*b* on crossbar 30 and 19*a* and 19*b* on the upper portions of struts 36 and 38**), a number of additional elements of prior art designs are eliminated. This means of controlling the forward rocking motion, is simple in construction, but effective in result.

Figure 4:
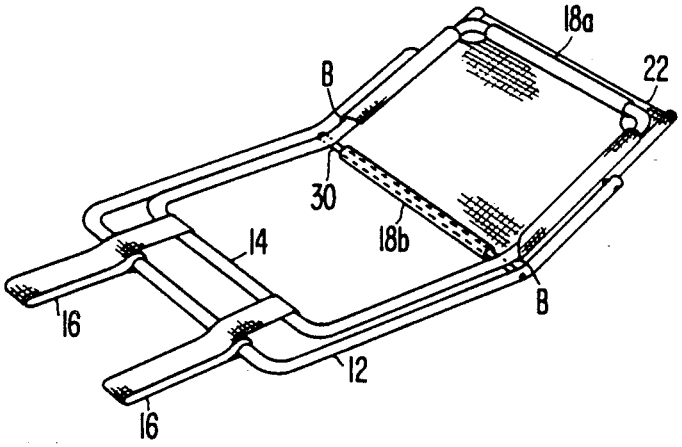
FIG. 4 is a perspective view of the chair of FIG. 1 in a folded and nested position.
Figure 5:
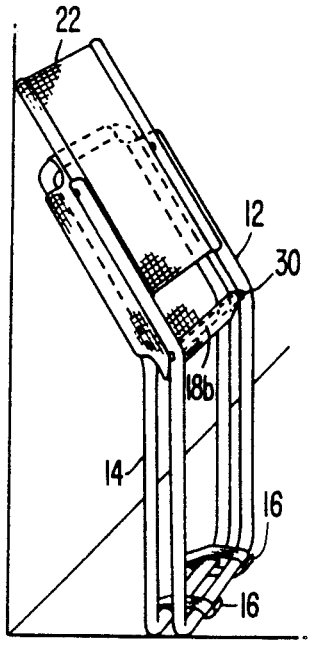
FIG. 5 is a perspective view of the chair of FIG. 1 in a folded position.

As seen in FIGS. 4 and 5, the chair 10 can be folded by moving the tension members 16 and 18 and placing the rear support member 14 adjacent to the front support member 12. The struts 36 and 38 in the rear support member 14 are spaced closer together than the struts 24 and 26 of the front support member 12. This allows the rear support member 14 to be nested within the front support member 12 when the structure is folded.

To further facilitate folding, angle A in struts 24 and 26 is approximately equal to angle A' in struts 36 and 38.

This allows the rear support member to fit conveniently within and adjacent the front support member in the folded position. Additionally, as seen in FIG. 5, the flexible strips forming first tension member 16 can be wrapped around crossbars 28 and 40 and held with Velcro or other similar joining means in order to maintain the chair in a compact folded configuration.

This detailed description is set forth only for purposes of illustrating an example of the present invention and should not be considered to limit the scope thereof in any way. Clearly, numerous additions, substitutions and other modifications can be made to the invention without departing from the scope of the invention which is defined in the appended claims and equivalents thereof.

What is claimed is:

1. A chair comprising:

a. a pair of transversely spaced, substantially straight front support members inclined from the horizontal, each front support member having a longitudinal axis and the axes of said front support members defining a planar surface;

b. a pair of transversely spaced rear support members each having a lower portion, which is oppositely inclined from the front support members, and an upper portion joined to, and angled from, the lower portion so as to extend forward in a generally horizontal direction defining a seat frame provided with a seating surface, said rear support members intersecting said planar surface adjacent the location where said lower portion is joined to said upper portion;

c. a lower tension member connected to the front support members and to the rear support members near the lower ends thereof defining a base; and d. a flexible upper tension member connected to the front and rear support members adjacent the intersection of the planar surface by said rear support members such that both pairs of support members are movable in a limited and controlled forward and rearward direction with respect to one another.

2. A chair of claim 1 further including a plurality of crossbars, and wherein:

the front support members comprise two generally parallel transversely spaced struts maintained in a fixed position relative to each other by upper and lower crossbars, and wherein the rear support members comprise two generally parallel transversely spaces struts maintained in a fixed position relative to each other also by upper and lower crossbars.

3. The chair of claim 2 wherein the upper tension member is secured to, and suspended between, the struts of the upper portion and the upper crossbar of the rear support member and the upper crossbar of the front support members to define the seating surface.

4. The chair of claim 3 further comprising a backrest attached to the front support members.

5. The chair of claim 4 wherein the backrest is pivotally disposed on the struts.

6. The chair of claim 5 wherein the struts of the rear support member are spaced closer together than the struts of the front support member such that the rear support member are nestable within the struts of the front support member when the chair is folded.

7. A chair comprising:

a. a pair of transversely spaced front support members inclined from the horizontal, each front support member having a longitudinal axis and the axes of said front support members defining a planar surface;

b. a pair of transversely spaced rear support members which are oppositely inclined from the front support members, each said rear support member having an upper end and intersecting said planar surface in the region of said upper end;

c. a seat frame provided with a seating surface fixed to the rear support members, said seat frame extending forward from the upper ends of the rear support members in a generally horizontal direction;

d. a lower flexible tension member connected to the front support members and to the rear support members; and e. a flexible upper tension member connected to the front and rear support members adjacent the intersection of the planar surface by said rear support members such that both pairs of support members are movable in a limited and controlled forward and rearward direction with respect to one another.

8. The chair of claim 7 further including a plurality of crossbars, and wherein:

the front support members comprise two generally parallel transversely spaced struts maintained in a fixed position relative to each other by upper and lower crossbars; the rear support members comprise two generally parallel transversely spaced struts maintained in a fixed position relative to each other by a lower crossbar; and the seat frame comprises two generally parallel transversely spaced members maintained in a fixed position relative to each other by an upper crossbar located to define a front edge of the seat frame.

9. The chair of claim 8 wherein the seat frame and the struts of the rear support members are integrally formed.

10. The chair of claim 9 wherein a first end of the seat frame is disposed adjacent said front support members, and the upper tension member is joined to said first end of said frame adjacent said front support members.

11. The chair of claim 10 further comprising a backrest attached to the front support members.

12. The chair of claim 11 wherein the struts of the front support members are bent to extend generally vertically upward beyond the upper tension member and the backrest is pivotally mounted on the struts.

13. A chair comprising:

a. a pair of transversely spaced front tubular support members inclined from the horizontal, each front support member having a longitudinal axis and the axes of said front support members defining a planar surface, and the front members having a lower end defining a base;

b. a rear tubular support member having two transversely spaced struts maintained in position relative to each other by upper and lower crossbars, said rear support member having a lower portion which is oppositely inclined from the front support members and having a lower end defining a base, an upper portion which is angled from the lower portion to define a generally horizontal seat frame provided with a seating surface, and said rear support member intersecting said planar surface adjacent the location where said upper portion is angled from said lower portion;

c. a backrest supported by the front support members;

d. a flexible lower tension member connected to the front support members and the lower portion of the rear support member near the base of the front support member and the base of the lower portion of the rear support member;

e. a flexible upper tension member connected to the front and rear support members adjacent the intersection of the planar surface by said rear support member such that both the support members are movable in a limited and controlled forward and rearward direction with respect to one another; wherein said chair is foldable by collapsing the flexible tension members and placing the rear support member adjacent the front support member.

14. In a folding chair having a first pair of transversely spaced rigid support members, each support member having a longitudinal axis and the axes of said first pair of support members being inclined with respect to the horizontal and defining an imaginary planar surface passing through said first pair of support members, upper and lower rigid crossbars between said first pair of support members maintaining said members in a substantially fixed relationship to each other, a second pair of transversely spaced rigid support members oppositely inclined from the first pair of support members with respect to the horizontal, having two upper portions defining a seat frame provided with a seating surface and two lower portions spaced from each other by a lower rigid crossbar, the improvement wherein said upper and lower portions of said second pair of support members are joined together at a location so that said upper portion is angled relative to said lower portion, said second pair of support members intersect the imaginary planar surface adjacent the location where said upper portion is joined to said lower portion, and said chair further comprises first and second tension members, said first tension member joined to said first and second pairs of support members adjacent the bottom thereof defining a base and said second tension member connected to the first pair of support members and the second pair of support members adjacent the intersection of the planar surface by said second pair of support members such that both pairs of support members are movable in a limited and controlled forward and rearward direction with respect to one another.

15. The chair of claim 14 wherein the second pair of support members, said frame and said lower crossbar of said second pair of support members are integral.

16. The chair of claim 14 further including a backrest disposed on said first pair of support members.

17. The chair of claim 14 wherein said first tension member is a flexible sheet of material.

18. The chair of claim 17 wherein said second tension member is a flexible sheet of material.

19. The chair of claim 8 wherein the upper tension member defines the seating surface and is secured to, and suspended between, the parallel members and upper crossbar of the seat frame an the upper crossbar of the front support members.

20. The chair of claim 13 wherein the upper tension member defines the seating surface and is secured to, and suspended between, said struts at said upper portion of said rear support member, said upper crossbar of said rear support member, and said front support member.

21. The chair of claim 14 wherein said second tension member defines the seating surface and is secured to, and suspended between, said upper portions of said second pair of support members and said upper crossbar of said first pair of support members.

* * * * *